US009392921B2

(12) United States Patent
Baek et al.

(10) Patent No.: US 9,392,921 B2
(45) Date of Patent: Jul. 19, 2016

(54) AGITATOR AND CLEANER

(71) Applicant: LG Electronics Inc., Seoul (KR)

(72) Inventors: Ohhyun Baek, Changwon-si (KR); Mingyu Kang, Changwon-si (KR)

(73) Assignee: LG ELECTRONICS INC., Seoul (KR)

( * ) Notice: Subject to any disclaimer, the term of this patent is extended or adjusted under 35 U.S.C. 154(b) by 505 days.

(21) Appl. No.: 13/790,970

(22) Filed: Mar. 8, 2013

(65) Prior Publication Data

US 2013/0232702 A1 Sep. 12, 2013

(30) Foreign Application Priority Data

Mar. 8, 2012 (KR) ..... 10-2012-0024150

(51) Int. Cl.
*A47L 9/04* (2006.01)
*A47L 11/40* (2006.01)

(52) U.S. Cl.
CPC ..... *A47L 11/4041* (2013.01); *A47L 9/0455* (2013.01); *A47L 9/0477* (2013.01); *A47L 2201/00* (2013.01)

(58) Field of Classification Search
CPC .... A47L 11/40; A47L 11/4041; A47L 9/0477
See application file for complete search history.

(56) References Cited

U.S. PATENT DOCUMENTS

| | | | | |
|---|---|---|---|---|
| 4,930,176 | A * | 6/1990 | Gelman | A47L 1/05 15/105 |
| 5,386,608 | A * | 2/1995 | Montabaur | A46B 13/001 15/179 |
| 6,912,755 | B2 * | 7/2005 | Chen | B23B 31/4073 15/179 |
| 7,636,982 | B2 * | 12/2009 | Jones | A47L 5/30 15/319 |
| 2008/0148512 | A1 * | 6/2008 | Beskow | A47L 9/04 15/350 |

* cited by examiner

*Primary Examiner* — Randall Chin
(74) *Attorney, Agent, or Firm* — Dentons US LLP

(57) ABSTRACT

There is provided a cleaner including an agitator, and a mounting portion on which the agitator is rotatably mounted. The agitator includes a brush assembly having brushes, a frame that includes a first opening into which the brush assembly is inserted, an installation space for receiving therein the brush assembly, and a second opening through which the brushes protrude, and first and second side caps that are connected to the frame and support the brush assembly.

15 Claims, 11 Drawing Sheets

AGITATOR AND CLEANER

CROSS-REFERENCE TO RELATED APPLICATIONS

The present application claims priority under 35 U.S.C. 119 and 35 U.S.C. 365 to Korean Patent Application No. 10-2012-0024150 (filed on Mar. 8, 2012), which is hereby incorporated by reference in its entirety.

BACKGROUND

The present disclosure relates to a cleaner.

The cleaner is an electrical appliance that performs a cleaning operation of removing foreign substances from a cleaning target region. The cleaner includes a suction unit for supplying a suction force for sucking air including the foreign substances from a cleaning target object into the cleaner and an agitator for separating the foreign substances from the cleaning target object. In general, the agitator is rotatably installed at the cleaner, and pressurizes or rakes the cleaning target object to separate the foreign substances from the cleaning target object.

The agitator includes a body and a plurality of brushes. The body is rotatably installed in the cleaner. The brushes are fixed onto an outer surface of the body. The brushes are generally arranged at the outer surface of the body in a spiral.

Disadvantageously, in such a conventional cleaner, the body is manufactured, and then the brushes are fixed onto the outer surface of the body. By way of example, the body is manufactured through injection molding, and the brushes are fixed to the body such that the brushes are arranged in holes formed in the outer surface of the body in a spiral. Accordingly, in the conventional cleaner, it is disadvantageous to easily manufacture the agitator.

SUMMARY

In accordance with embodiments, there are provided a cleaner and an agitator.

In accordance with one aspect, there is provided a cleaner including an agitator, and a mounting portion on which the agitator is rotatably mounted. The agitator includes a brush assembly having brushes, a frame that includes a first opening into which the brush assembly is inserted, an installation space for receiving the brush assembly, and a second opening through which the brushes protrude, and first and second side caps that are connected to the frame and support the brush assembly.

In accordance with another aspect, there is provided an agitator including a frame having an installation space, at least one first opening communicating with the installation space, and a plurality of second openings, a brush assembly that is installed in the installation space through the at least one first opening and includes a plurality of brushes protruding outward from the frame through the second openings, and first and second side caps that are fixed to the frame to support the brush assembly.

The details of one or more embodiments are set forth in the accompanying drawings and the description below. Other features will be apparent from the description and drawings, and from the claims.

DETAILED DESCRIPTION OF THE EMBODIMENTS

Reference will now be made in detail to the embodiments of the present disclosure, examples of which are illustrated in the accompanying drawings.

In the following detailed description of the preferred embodiments, reference is made to the accompanying drawings that form a part hereof, and in which is shown by way of illustration specific preferred embodiments in which the invention may be practiced. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense.

Figure 1:
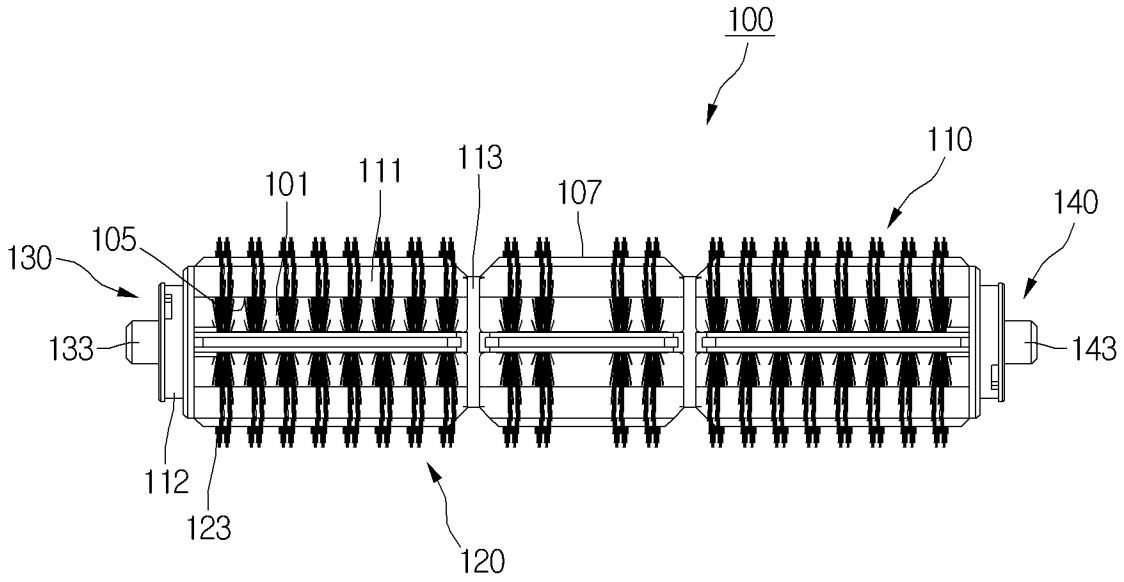
FIG. 1 is a plan view of an agitator in accordance with a first embodiment.
Figure 2:
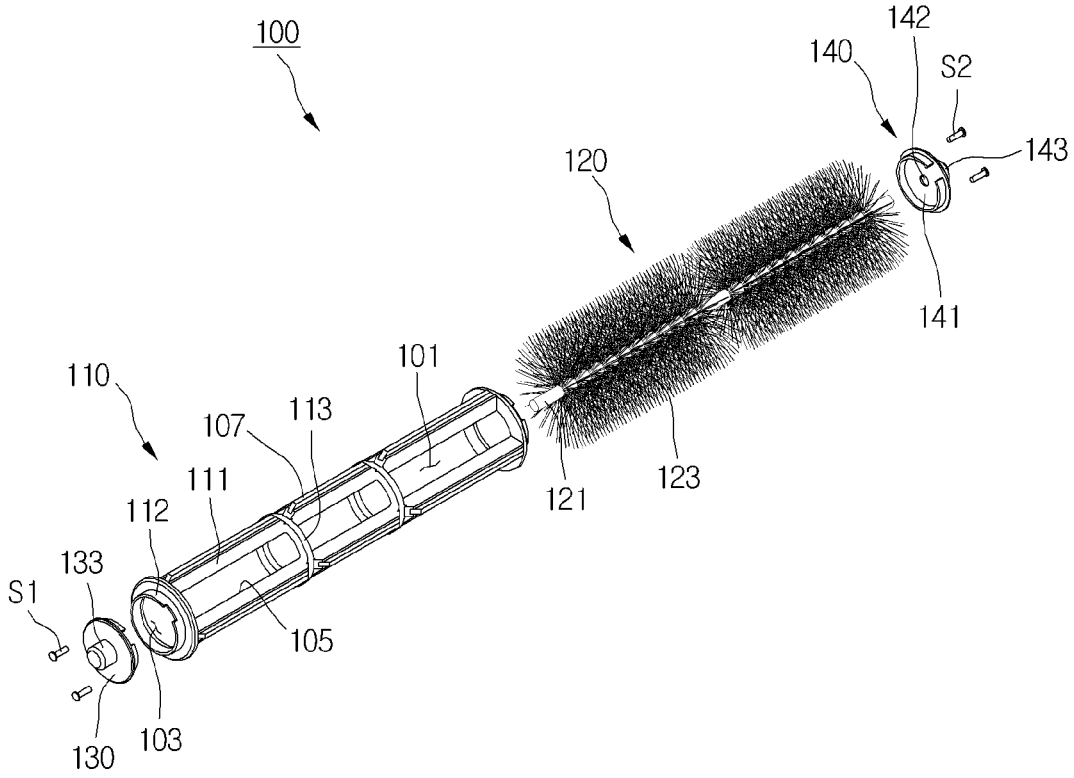
FIG. 2 is an exploded perspective view of the agitator in accordance with the first embodiment.

FIG. 1 is a plan view of an agitator in accordance with a first embodiment, and FIG. 2 is an exploded perspective view of the agitator in accordance with the first embodiment.

Referring to FIGS. 1 and 2, an agitator 100 of this embodiment is installed at a cleaner (a cleaner main body or a nozzle) to separate foreign substances from a cleaning target object. The agitator 100 includes a frame 110, a brush assembly 120, and a plurality of side caps 130 and 140.

The frame 110 includes first to third members 111 to 113. The first member 111 includes four bodies having the same length. The number of the bodies of the first member 111 is not particularly limited thereto. In this embodiment, the first members 111 are parallel to each other in the same direction as a virtual axis (central axis) of symmetry and are symmetrically positioned around the axis of symmetry.

The second members 112 are connected to both ends of the first members 111, respectively. The second members 112 are positioned on a virtual plane perpendicular to the first members 111. The second members 112 connect the ends of the first members 111. Thus, a certain space, that is, a cylindrical hollow space, is formed by the first and second members 111 and 112.

The third members 113 connect the first members 111 to reinforce the first members 111. By way of example, the third members 113 are positioned on a virtual plane perpendicular to the first members 111. At this time, the virtual plane on which the third members 113 are positioned is parallel to the virtual plane on which the second members 112 are positioned. That is, the third members 113 are positioned to be spaced apart from the second members 112 in a longitudinal direction of the first members 111 by a predetermined distance.

The first members 111 may be referred to as a transversal member or a main member depending on a shape and/or a function thereof. Further, the second and third members 112 and 113 may be referred to as a side member and a reinforcing member, respectively. Specifically, the first to third members 111 to 113 may be integrally formed with each other.

Further, an installation space 101 at which the brush assembly 120 is positioned is formed within the frame 110. Specifically, the installation space 101 means a cylindrical hollow space defined by the first and second members 111 and 112. Two installation openings 103 (first openings) and a plurality of through openings 105 (second openings) communicating with the installation space 101 are formed in the frame 110. The installation openings 103 are formed by cutting off parts of the second members 112. The through openings 105 are defined as spaces between the first members 111 adjacent to each other.

In addition, a plurality of squeegees 107 is provided at the frame 110. The squeegees 107 rake the foreign substances from the cleaning target object. Specifically, the squeegees 107 are provided at an outer surface of the frame 110, that is, the first members 111. By way of example, the squeegees 107 may be integrally formed with the frame 110, that is, the first member 111, or may be coupled to the frame 110. The squeegees 107 may be made from a rubber material or a material capable of changing its shape.

The brush assembly 120 includes a rod 121 and a plurality of brushes 123. A length of the rod 121 is larger than that of the first member 111. Specifically, the brushes 123 come in contact with the cleaning target object, for example, a floor to remove the foreign substances from the cleaning target object. The brushes 123 are fixed onto an outer surface of the rod 121. The brushes 123 may radially extend from the outer surface of the rod 121. By way of example, the brushes 123 may be arranged in a spiral along the rod 121. At this time, a distance between the rod 121 and the brush 123 is larger than a distance between the virtual central axis of the frame 110 and the end of the first member 111.

The brush assembly 120 is inserted into the frame 110, that is, the installation space 101, through the installation opening 103. At this time, the rod 121 protrudes outward from the frame 110 through the installation opening 103. The brushes 123 protrude outward from the frame 110 through the through openings 105 while the brush assembly 120 is inserted into the installation space 101.

The side caps 130 and 140 serve to support the brush assembly 120. The side caps 130 and 140 are fixed to the both ends of the frame 110, specifically, the second members 112, respectively. Thus, the side caps 130 and 140 cover the installation openings 103.

Supporting grooves 142 are formed at the side caps 130 and 140, respectively. Both ends of the brush assembly 120, specifically, both ends of the rod 121 are inserted into the supporting grooves 142. In this embodiment, the supporting grooves 142 are formed at supporting portions 141 of the side caps 130 and 140.

Coupling projections 133 and 143 are formed at the supporting portions 141. The coupling projections 133 and 143 protrude from the side caps 130 and 140 by a predetermined length. The coupling projections 133 and 143 are coupled to first and second couplers 300 and 400 to be described below to rotatably support the agitator 100 and to receive a driving force for rotating the agitator 100. The coupling projections 133 and 143 may be formed in a polyhedral shape having a substantially polygon-shaped longitudinal cross section. Hereinafter, for the convenience of explanation, among the side caps 130 and 140, the side cap on a left side in the drawings is referred to as the first side cap 130, and the side cap on a right side in the drawings is referred to as the second side cap 140.

Hereinafter, a process of assembling the agitator in accordance with this embodiment will be described in detail.

Figure 3:
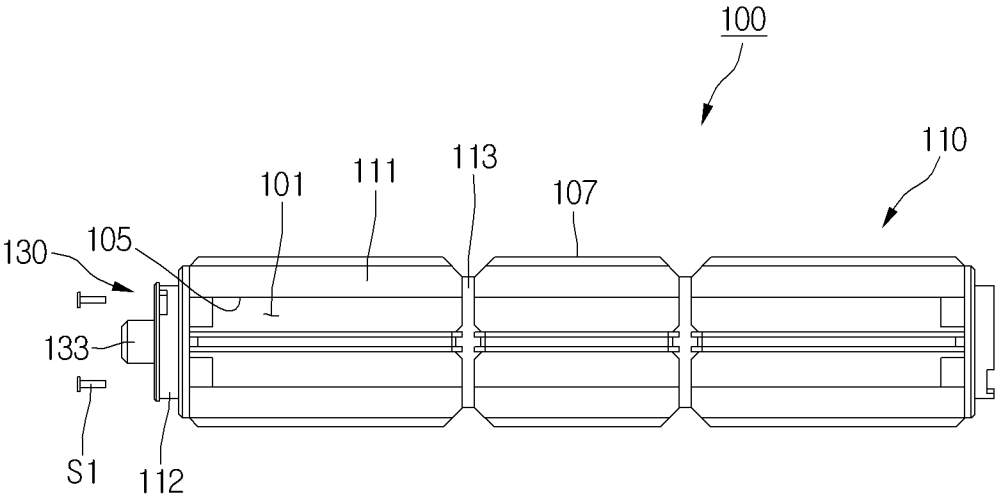
FIGS. 3 and 4 are plan view illustrating a process of assembling the agitator in accordance with the first embodiment.
Figure 4:
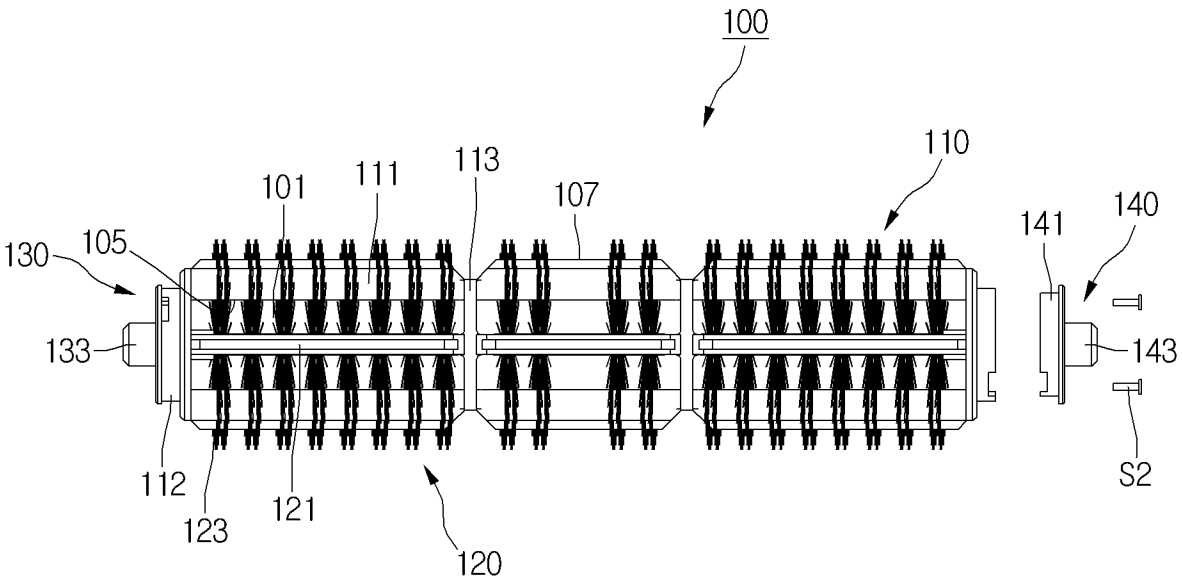

FIGS. 3 and 4 are plan views illustrating a process of assembling the agitator in accordance with the first embodiment.

First, referring to FIG. 3, the first side cap 130 is fixed to one end of the frame 110, specifically, any one of the second members 112. The first side cap 130 may be fixed to the second member 112 by a clamping member S1. Alternatively, the first side cap 130 is forcibly inserted into the second member 112.

Next, referring to FIG. 4, the brush assembly 120 is inserted into the frame 110, that is, the installation space 101, through the installation opening 103 formed in the other end of the frame 110, that is, the other of the second members 112. At this time, when the brush assembly 120 is inserted into the installation space 101 to be installed, one end of the rod 121 is inserted into the supporting groove of the first side cap 130. Then, when the brush assembly 120 is inserted into the installation space 101 to be installed, the brushes 123 protrude outward from the installation space 101 through the through openings 105.

Lastly, the second side cap 140 is fixed to the other end of the frame 110, that is, the other of the second members 112. Similarly to the first side cap 130, the second side cap 140 is fixed to the second member 112 by a separate clamping member S2. Then, when the second side cap 140 is fixed to the other end of the frame 110, the other end of the rod 121 is inserted into the supporting groove 142 of the second side cap 140, so that the assembling of the agitator 100 is completed.

The agitator 100 may be assembled using a method different from the aforementioned assembling method. By way of example, the brush assembly 120 is installed in the frame 110, that is, the installation space 101, and then the first and second side caps 130 and 140 may be fixed to the frame 110.

Figure 5:
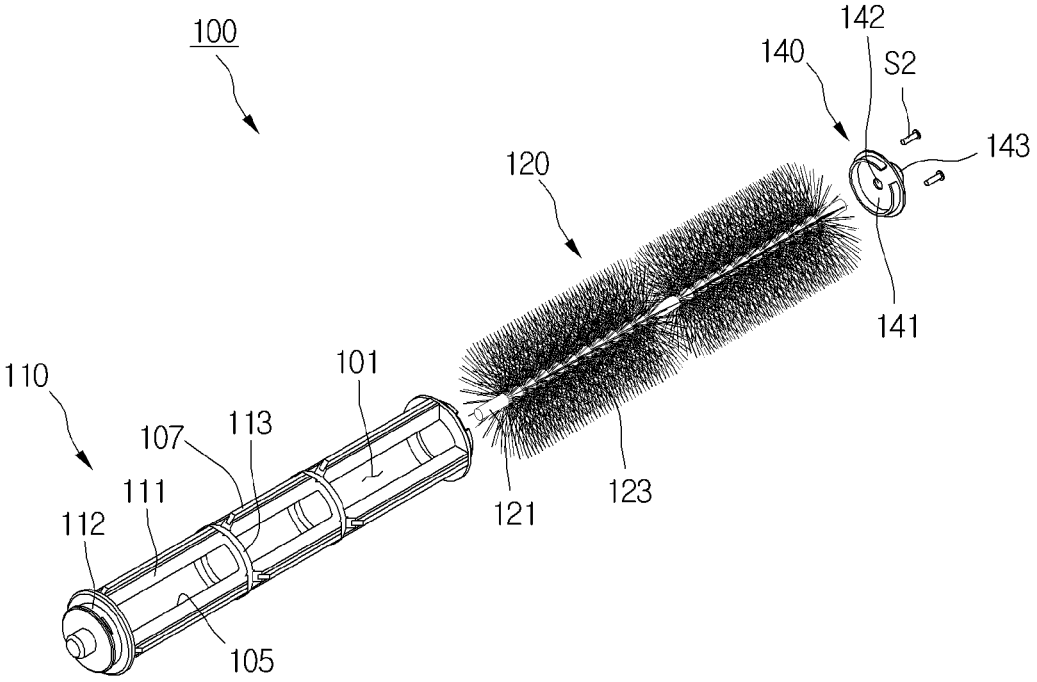
FIG. 5 is an exploded perspective view of an agitator in accordance with a second embodiment.

FIG. 5 is an exploded perspective view of an agitator in accordance with a second embodiment. In this embodiment, the same parts as those in the first embodiment will be assigned the same reference numerals as those in FIGS. 1 to 4, and redundant description thereof will be omitted.

Referring to FIG. 5, an agitator 100 of this embodiment includes the frame 110, the brush assembly 120, and one side cap 140. In this embodiment, any one of the side caps 130 and 140 of the agitator in accordance with the first embodiment of the present invention, by way of example, but not limited to, the first side cap 130 is integrally formed with the frame 110.

Accordingly, in this embodiment, a supporting groove for supporting the brush assembly 120, specifically, the one end of the rod 121 is formed at the one end of the frame 110, that is, any one of the second members 112.

Figure 6:
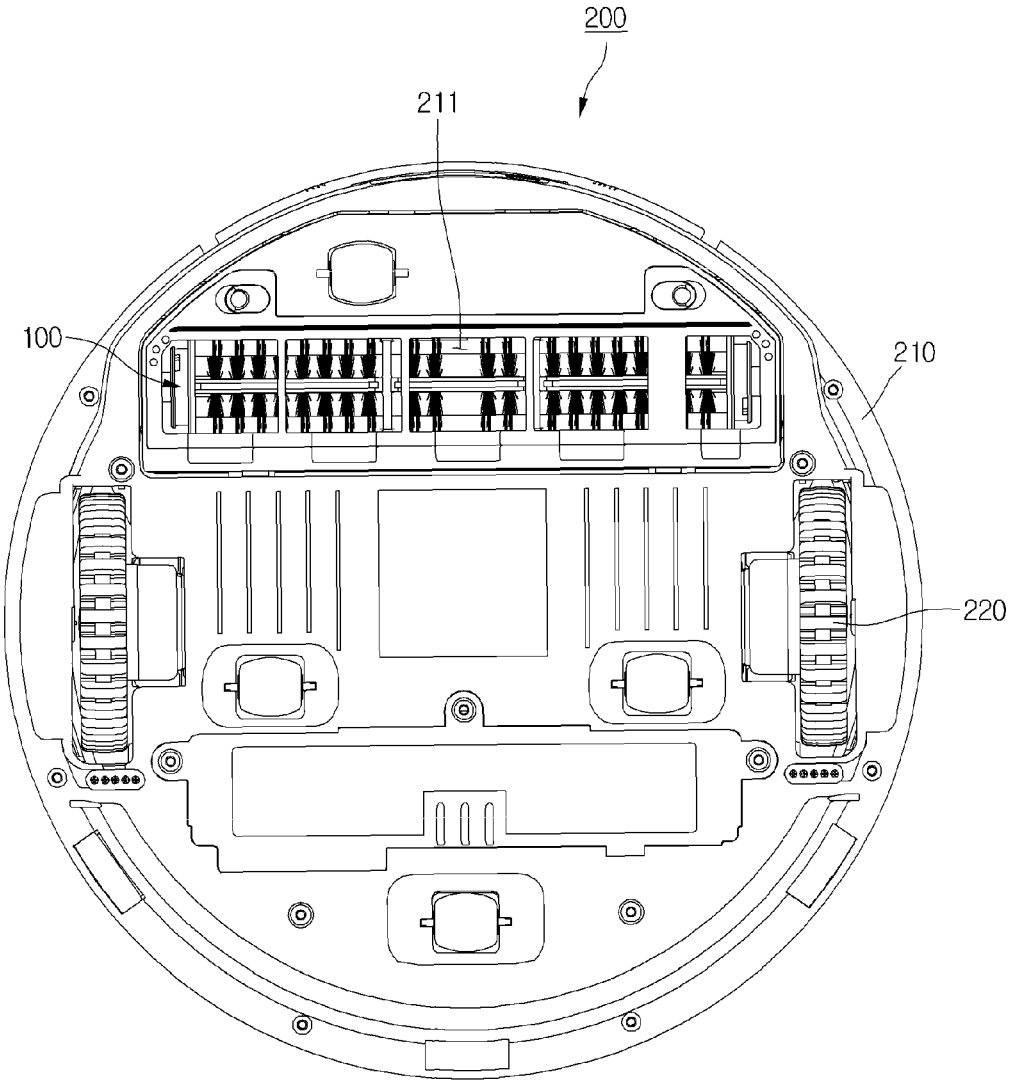
FIG. 6 is a bottom view of a cleaner in accordance with a first embodiment.
Figure 7:
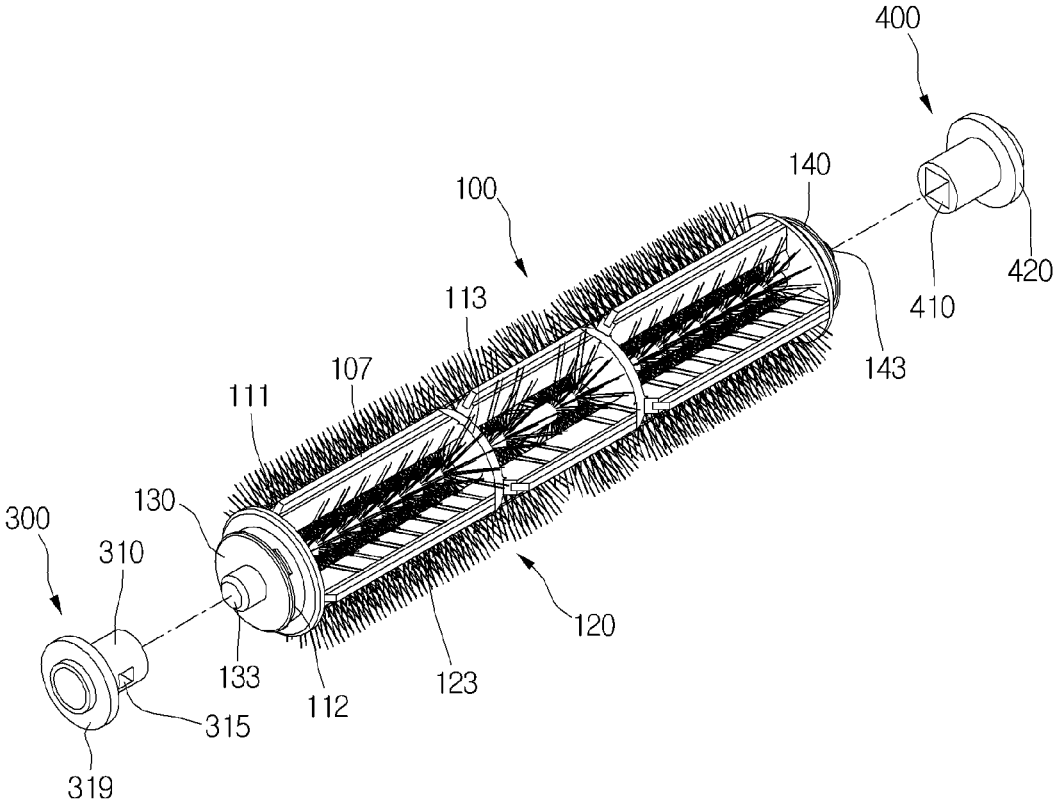
FIG. 7 is an exploded perspective view illustrating a partial configuration of the cleaner in accordance with the first embodiment.
Figure 8:
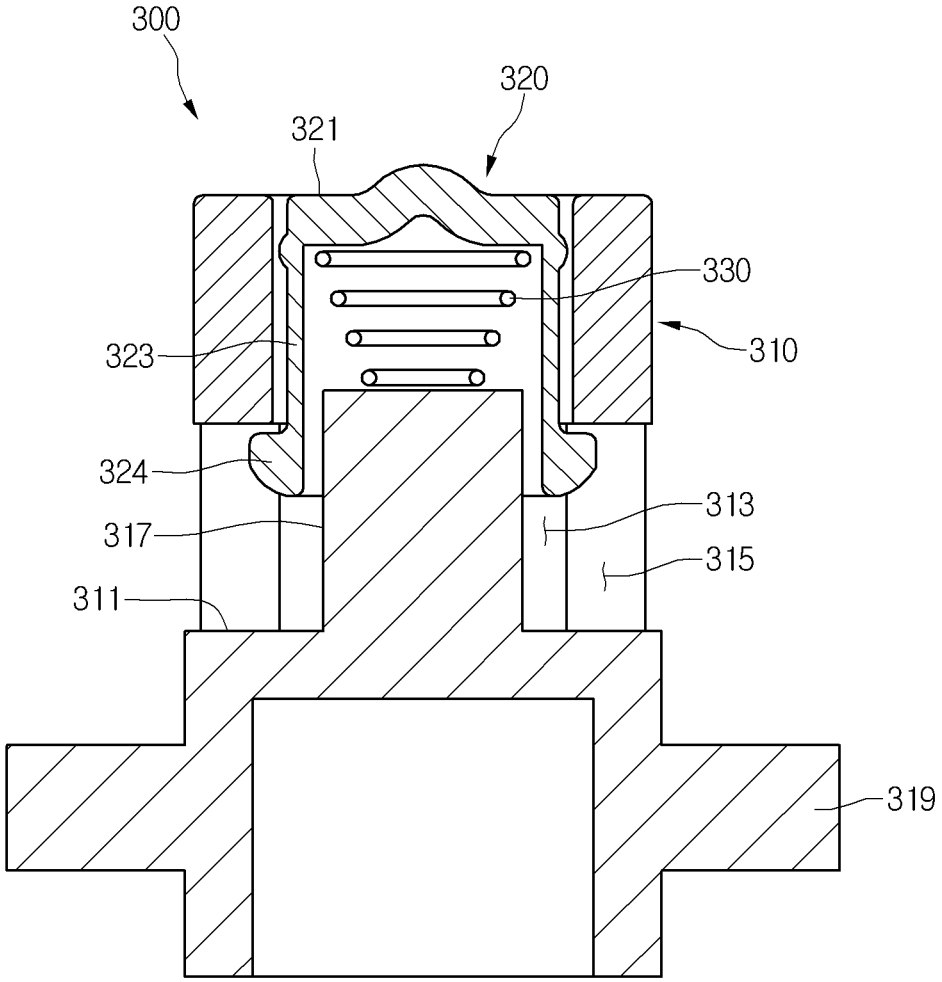
FIG. 8 is a longitudinal cross-sectional view illustrating a first coupler of the cleaner in accordance with the first embodiment.

FIG. 6 is a bottom view of a cleaner in accordance with a first embodiment, FIG. 7 is an exploded perspective view illustrating a partial configuration of the cleaner in accordance with the first embodiment, and FIG. 8 is a longitudinal cross-sectional view illustrating a first coupler of the cleaner in accordance with the first embodiment.

First, referring to FIG. 6, an example of using a robot cleaner 200 among various types of cleaners will be described in this embodiment. The robot cleaner 200 performs a cleaning operation of removing the foreign substances while running on a certain cleaning target region. Various parts of the robot cleaner 200 are installed within a main body 210 of the robot cleaner 200. By way of example, a running unit 220 for running, a suction unit (not shown) for sucking air including foreign substances, and a dust collecting unit (not shown) for collecting the foreign substances separated from the sucked air may be provided within the main body 210.

A suction opening 211 is formed in a bottom surface of the main body 210. The suction opening 211 serves as an inlet for sucking the air including the foreign substances into the main body 210 by the suction unit, specifically, the dust collecting unit. The suction opening 211 is formed by cutting off a part of the bottom surface of the main body 210.

The agitator 100 is installed above the suction opening 211 in the main body 210. The agitator 100 comes in contact with the cleaning target object through the suction openings 211 to remove the foreign substances. The agitator 100 may be rotated by a driving force of a driving motor (not shown) installed within the main body 210 while the agitator 100 is exposed downward through the suction opening 211. As the agitator 100, any one of the agitators of the first and second embodiments of the present invention may be used.

Referring to FIGS. 7 and 8, the first and second couplers 300 and 400 are installed within the main body 210. The first and second couplers 300 and 400 support the agitator 100, and transfer the driving force of the driving motor to the agitator 100. To achieve this, the first and second couplers 300 and 400 are spaced apart from each other in a rotational axis direction of the agitator 100 by a predetermined distance, and are arranged to face each other. Specifically, a distance between the first and second couplers 300 and 400 is set to be a value, which is equal to or greater than a length of the agitator 100 excluding the coupling projections 133 and 143, that is, a distance between the side caps 130 and 140 and is less than a distance between front ends of the coupling projections 133 and 143. The first and second couplers 300 and 400 are rotatably installed within the main body 210. Any one of the first and second couplers 300 and 400 is rotated by the driving motor to transfer the driving force to the agitator 100.

Specifically, any one of the coupling projections 133 and 143 is inserted into the first coupler 300. The first coupler 300 includes a fixing member 310, a moving member 320, and an elastic member 330.

The fixing member 310 may be formed in a polygon hollow shape, for example, a cylindrical shape, having a predetermined length in the rotational axis direction of the agitator 100. A partition plate 311 is provided within the fixing member 310. Specifically, the partition plate 311 and an inner surface of the fixing member 310 define a first coupling groove 313 into which the coupling projection 133 or 143 is inserted.

Further, a plurality of guide slots 315 is formed in an outer surface of the fixing member 310. The guide slots 315 guide the movement of the moving member 320. The guide slots 315 are formed by cutting off parts of the outer surface of the fixing member 310 in a longitudinal direction of the fixing member 310. In this embodiment, the plurality of guide slots 315 is formed to be spaced apart from each other from a center of the fixing member 310 in a longitudinal cross section.

In addition, a supporting protrusion 317 is provided within the fixing member 310, specifically, within the first coupling groove 313. The supporting protrusion 317 protrudes from one surface of the partition plate 311. Here, the supporting protrusion 317 has a length relatively shorter than a depth of the first coupling groove 313. Thus, substantially, a front end of the supporting protrusion 317 is positioned within the first coupling groove 313.

Meanwhile, a first supporting flange 319 is provided at one side of the outer surface of the fixing member 310. The first supporting flange 319 radially extends from the outer surface of the fixing member 310. The first supporting flange 319 rotatably supports the fixing member 310 within the main body 210.

The partition plate 311, the supporting protrusion 317, and the first supporting flange 319 may be integrally formed. When the fixing member 310 is formed in a cylindrical hollow shape whose one surface is covered, the covered one surface of the fixing member 310 may substantially serve as the partition plate 311.

The moving member 320 is installed to be movable in the rotational axis direction of the agitator 100 with respect to the fixing member 310. Specifically, the moving member 320 is provided within the first coupling groove 313, and is movable within the first coupling groove 313. The moving member 320 includes a pressing portion 321 and a plurality of guide portions 323.

The pressing portion 321 may be formed in a plate shape corresponding to a longitudinal cross section of the first coupling groove 313. The pressing portion 321 may be pressed by the coupling projection 133 or 143 of the side cap 130 or 140.

The guide portions 323 extend from an outer surface of the pressing portion 321 in a direction perpendicular to one surface of the pressing portion 321, respectively. The guide portions 323 are integrally formed with the pressing portion 321, and are formed to be resiliently changable with respect to the pressing portion 321.

Guide protrusions 324 are formed at front ends of the guide portions 323, respectively. When the moving member 320 is provided within the first coupling groove 313, the guide protrusions 324 are positioned on the guide slots 315, respectively. When the moving member 320 is moved within the first coupling groove 313 in the rotational axis direction of the agitator 100, the guide protrusions 324 slide along the guide slots 315. In addition, when the moving member 320 is moved in the rotational axis direction of the agitator 100 with respect to the fixing member 310, the guide protrusions 324 come in contact with both ends of the guide slots 315, so that a moving distance of the moving member 320 is regulated, or the moving member 320 is prevented from being deviated from the first coupling groove 313.

The elastic member 330 is positioned within the first coupling groove 313, specifically, between the supporting protrusion 317 and the pressing portion 321. The elastic member 330 is compressed by the moving member 320 pressed by the coupling projection 133 or 143 of the side cap 130 or 140. Thus, the elastic member 330 applies an elastic force to the moving member 320 in a direction opposite to a direction in which the moving member 320 is pressed by the coupling projection 133 or 143 of the side cap 130 or 140.

In this embodiment, a coil spring whose both ends are supported by the front end of the supporting protrusion 317 and one surface of the pressing portion 321 is used as the elastic member 330. Accordingly, it is possible to minimize a height of the elastic member 330 when the elastic member 330 is compressed by the moving member 320. Specifically, by minimizing the height of the elastic member 330, when a distance by which the first and second couplers 300 and 400 are spaced apart from each other is under the same condition, it is possible to maximize a distance between one surface of the moving member 320 and a base of a second coupling groove 410 to be described below.

Meanwhile, specifically, the moving member 320 is moved in the rotational axis direction of the agitator 100 with respect to the fixing member 310 to be located at any one position of a first position to a third position. Here, the first position means a position of the moving member 320 closest to the second coupler 400 by the elastic force of the elastic member 330 while the moving member 320 is not pressed by the coupling projection 133 or 143 of the side cap 130 or 140, that is, the first position means the outermost position in the first coupling groove 313. When the moving member 320 is located at the first position, the elastic member 330 is maintained at an initial position, for example, a state in which the elastic member 330 is not compressed by the moving member 320 or a state in which the elastic member 320 is minimally compressed by the moving member 320. The second position means a position of the moving member 320 farthest away from the second coupler 400 by being pressed by the coupling projection 133 or 143 of the side cap 130 or 140, that is, the innermost position in the first coupling groove 313. When the moving member 320 is located at the second position, the elastic member 330 becomes maximally compressed by the moving member 320. The third position means an arbitrary position between the first position and the second position.

Meanwhile, a second coupling groove 410 into which the coupling projection 143 is inserted is formed at the second coupler 400. A second supporting flange 420 is provided at the second coupler 400. The second supporting flange 420 rotatably supports the second coupler 400 within the main body 210.

The first and second coupling grooves 313 and 410 are arranged at the rotational axis of the agitator 100 while the first and second couplers 300 and 400 are installed in the main body 210.

In this embodiment, when the moving member 320 is located at the second position, a distance between one surface of the moving member 320 and a front end of the second coupler 400 facing the first coupler 300 is set to be a value greater than a distance between front ends of the coupling projections 133 and 143. Moreover, when the moving member 320 is located at the third position, the distance between the one surface of the moving member 320 and the front end of the second coupler 400 facing the first coupler 300 is set to be a value, which is equal to or greater than a distance between both ends of the agitator 100 excluding the coupling projections 133 and 143 and is less than a distance between the front ends of the coupling projections 133 and 143.

Hereinafter, a process of installing the agitator at the cleaner in accordance with the first embodiment of the present invention will be explained in more detail with reference to the accompanying drawings.

Figure 9:
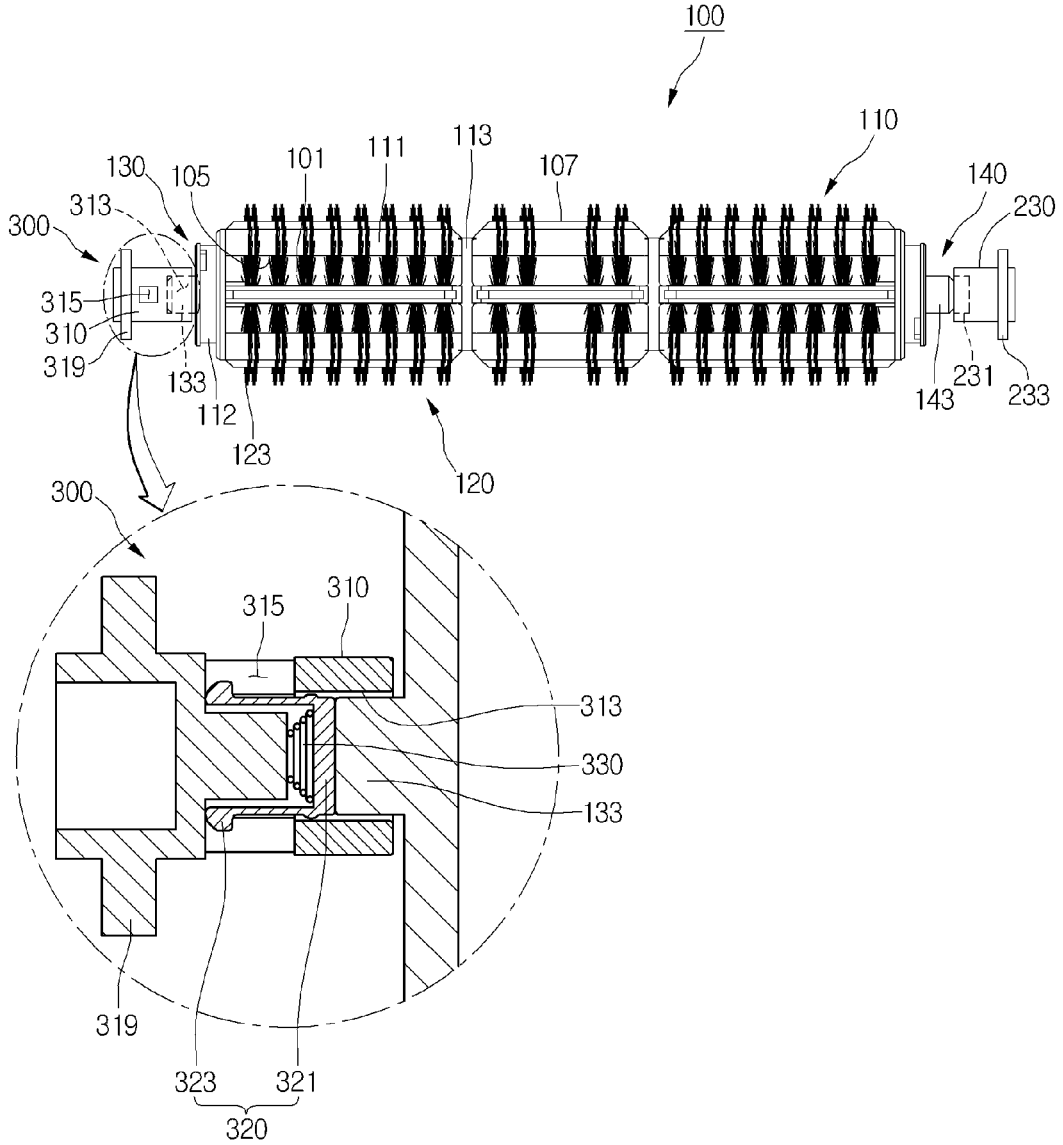
FIGS. 9 and 10 are plan view illustrating a process of installing the agitator at the cleaner in accordance with the first embodiment.
Figure 10:
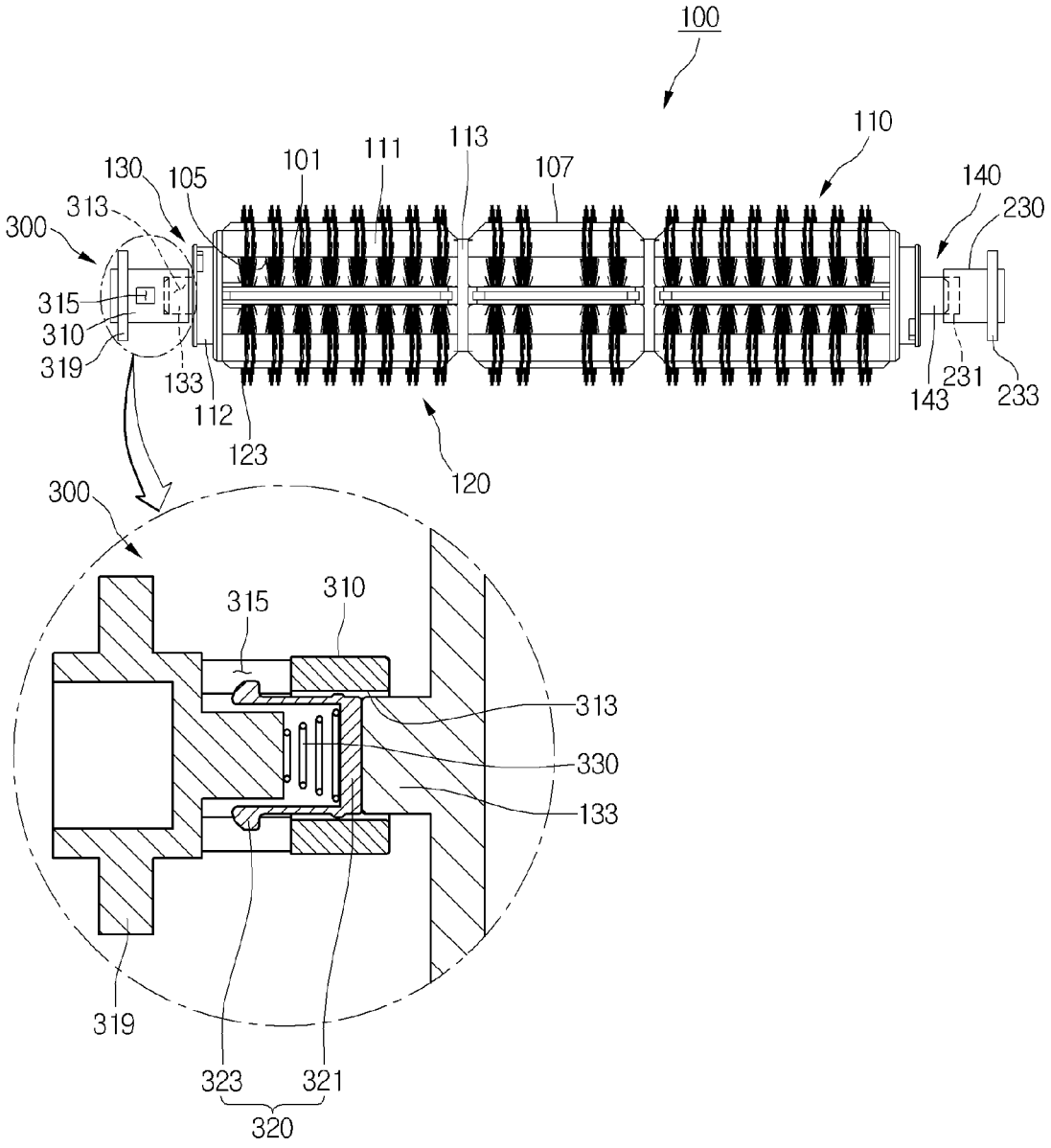

FIGS. 9 and 10 are plan views illustrating a process of installing the agitator at the cleaner in accordance with the first embodiment.

When the agitator 100 is not coupled to the first and second couplers 300 and 400, the moving member 320 is not pressed by the coupling projections 133 and 143 of the side caps 130 and 140. Accordingly, the moving member 320 is located at the first position by the elastic force of the elastic member 330.

In such a state, as shown in FIG. 9, the agitator 100 is moved to couple any one of the coupling projections 133 and 143 to the first coupler 300. That is, any one of the coupling projections 133 and 143 is inserted into the first coupling groove 313. At this time, the moving member 320 is pressed by the coupling projection 133 or 143 to restore the elastic force of the elastic member 330 and is then moved from the first position to the second position. Here, the guide protrusions 324 guide the movement of the moving member 320 while the guide protrusions 324 are moved along the guide slots 315.

Next, the second coupling groove 410 and the other of the coupling projections 133 and 143 are aligned. When the moving member 320 is located at the second position, a distance between the one surface of the moving member 320 and a base of the second coupling groove 410 is set to be a value greater than a distance between the front ends of the coupling projections 133 and 143.

Lastly, as shown in FIG. 10, the agitator 100 is moved toward the second coupler 400 to allow the coupling protrusion 143 to be inserted into the second coupling groove 410. Then, when the agitator 100 is moved toward the second coupler 400 to allow the coupling projection 143 to be inserted into the second coupling groove 410, the moving member 320 is moved toward the first position by the elastic force of the elastic member 330 to be located at any one position between the first and second positions, that is, the third position. However, when the moving member 320 is located at the third position, the distance between the one surface of the moving member 320 and the front end of the second coupler 400 facing the first coupler 300 is set to be a value, which is equal to or greater than the distance between the both ends of the agitator 100 excluding the coupling projections 133 and 143 and is less than the distance between the coupling projections 133 and 143. Thus, the agitator 100 is coupled to the first and second couplers 300 and 400 so as not to be arbitrary separated therefrom. In addition, when the moving member 320 is located at the third position, the coupling projection 133 is pressed by the moving member 320.

Meanwhile, a process of separating the agitator 100 from the first and second couplers 300 and 400 will be performed in a reverse order to the coupling process described above. That is, the agitator 100 is moved toward the first coupler 300 to press the moving member 320, and thus the coupling protrusion 143 is deviated from the second coupling groove 410. In such a state, by allowing the coupling protrusion 143 to be deviated from the first coupling groove 313, the agitator 100 can be separated from the first and second couplers 300 and 400.

Hereinafter, a cleaner in accordance with a second embodiment of the present invention will be explained in more detail with reference to the accompanying drawings.

Figure 11:
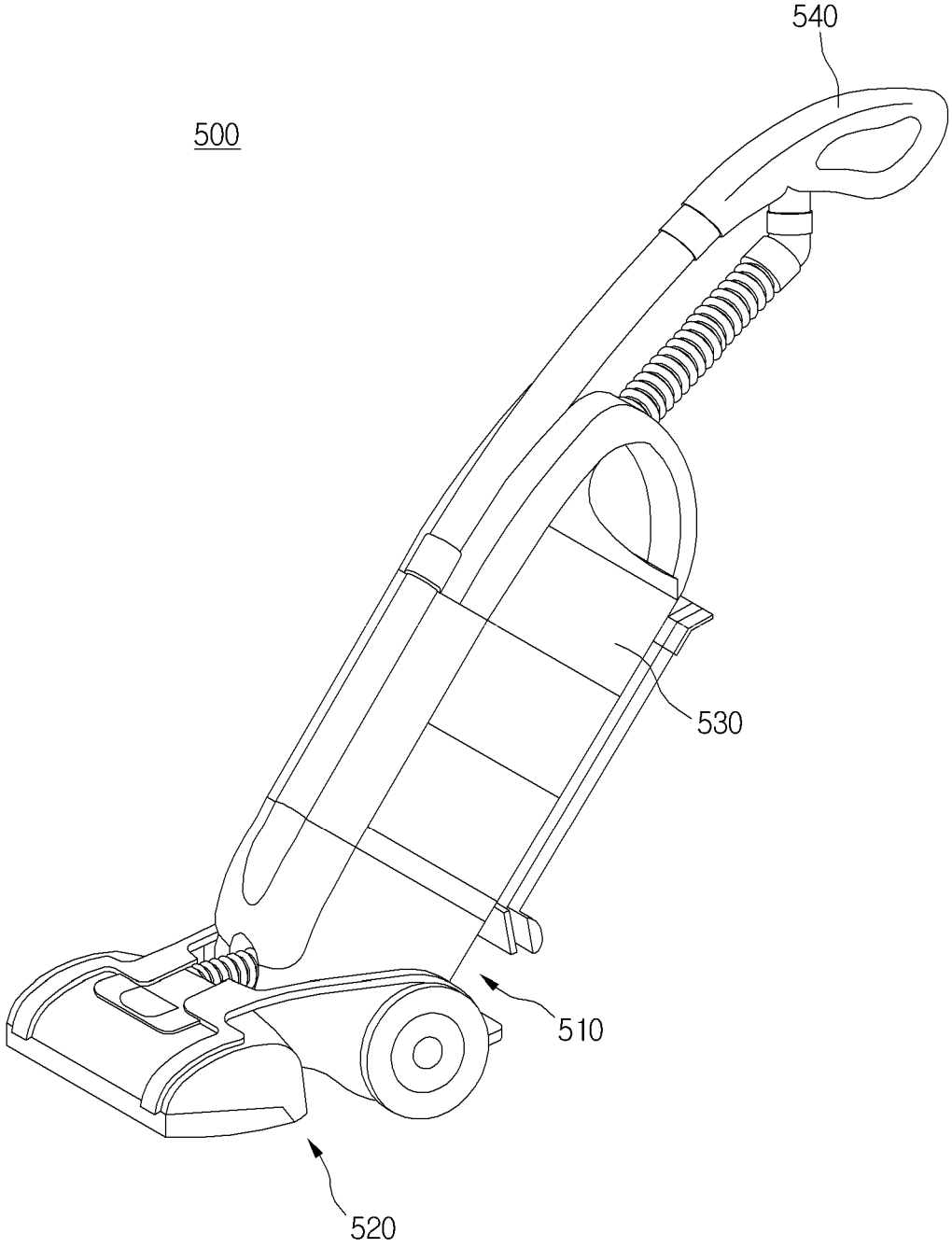
FIG. 11 is a perspective view of a cleaner in accordance with a second embodiment.

FIG. 11 is a perspective view of a cleaner in accordance with a second embodiment.

Referring to FIG. 11, an upright cleaner 500 will be described in this embodiment. The upright cleaner 500 includes a main body 510, a suction nozzle 520, a dust collecting unit 530, and a handle 540. A suction motor (not shown) for supplying the suction force for sucking the air including the foreign substances is installed in the main body 510. The suction nozzle 520 is located at a lower end of the main body 510. Specifically, the suction nozzle 520 is connected to the main body 510 to suck the air including the foreign substance. The dust collecting unit 530 is detachably installed at one side of the main body 510. The dust collecting unit 530 collects the foreign substances separated from the air sucked through the suction nozzle 520. The handle 540 extends from an upper end of the main body 510. The handle 540 is held by a user to operate the upright cleaner 500.

An agitator (not shown) is installed within the suction nozzle 520. The agitator separates the foreign substances from the cleaning target object. Specifically, as the agitator, any one of the agitators in accordance with the first and second embodiments of the present invention is used.

It should be understood by those skilled in the art that various modifications can be made without changing the technical conception of the present invention, and that the scope of the present invention is defined by the appended claims.

The aforementioned embodiments have been described in connection with the robot cleaner and the upright cleaner as examples. However, the agitator may be applied to a typical vacuum cleaner.

In addition, although the aforementioned embodiments have been described that the first and second couplers have different configurations to each other, the second coupler may have the same configuration as the first coupler.

In the present specification, a portion of the cleaner to which the agitator is attached is referred to as a mounting portion. The mounting portion may be the main body or the nozzle of the cleaner, and a position to which the agitator is attached is not particularly limited.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A cleaner, comprising:

an agitator; and a mounting portion on which the agitator is rotatably mounted, wherein the agitator includes:

a brush assembly having brushes, a frame that includes a first opening into which the brush assembly is inserted, an installation space to receive the brush assembly, and a second opening through which the brushes protrude, first and second side caps that are connected to the frame and support the brush assembly, and first and second couplers that are connected to the first and second side caps, respectively, and are rotatably installed at the mounting portion, wherein first coupler includes:

a fixing member, and a moving member that is movably coupled to the fixing member and connected to one of the first and second side caps.

2. The cleaner of claim 1, wherein the brush assembly includes a rod at which the brushes are installed, and the rod is coupled to the first and second side caps.

3. The cleaner of claim 1, wherein at least one of the first and second side caps is detachably coupled to the frame.

4. The cleaner of claim 1, wherein the frame includes a plurality of first members arranged in parallel to be spaced apart from each other and second members that connect ends of the plurality of first members.

5. The cleaner of claim 4, wherein a squeegee for cleaning a foreign substance is provided at any one of the plurality of first members.

6. The cleaner of claim 4, wherein the second opening is defined between the two first members adjacent to each other.

7. The cleaner of claim 1, wherein the first side cap includes a first coupling projection, and the second side cap includes a second coupling projection.

8. The cleaner of claim 7, wherein the fixing member defines a first coupling groove to which the first coupling projection is coupled, the moving member is movable in the first coupling groove.

9. The cleaner of claim 8, wherein the first coupler further includes:

an elastic member that elastically supports the moving member within the first coupling groove, and wherein the second coupler includes a second coupling groove to which the second coupling projection is coupled.

10. The cleaner of claim 9, wherein the moving member includes a pressing member pressed by the first coupling projection inserted into the first coupling groove and a guide portion that guides the movement of the moving member with respect to the fixing member.

11. The cleaner of claim 10, wherein the fixing member includes a guide slot that receives the guide portion.

12. The cleaner of claim 8, wherein a driving force of a driving motor for rotating the agitator by any one of the first and second couplers.

13. The cleaner of claim 9, wherein the moving member is located at a first position relatively closest to the second coupler before the first coupling projection is inserted into the first coupling groove, the moving member is located at a second position relatively farthest away from the second coupler when the coupling projection of the first side cap is inserted into the first coupling groove, and the moving member is located between the first position and the second position when the coupling projection of the first side cap is inserted into the first coupling groove and the coupling projection of the second side cap is inserted into the second coupling groove of the second coupler.

14. The cleaner of claim 13, wherein, when the moving member is located at the second position, a distance between one surface of the moving member and a front end of the second coupler facing the first coupler is greater than a distance between the first coupling projection and the second coupling projection.

15. The cleaner of claim 13, wherein, when the moving member is located at the first position, a distance between one surface of the moving member and a front end of the second coupler facing the first coupler is less than a distance the first coupling projection and the second coupling projection.

* * * * *